US006845542B2

(12) United States Patent
Rastegar et al.

(10) Patent No.: US 6,845,542 B2
(45) Date of Patent: Jan. 25, 2005

(54) PORTABLE, FULLY CONTAINED AND DISPOSABLE SUCTION DEVICE

(75) Inventors: Jahangir S. Rastegar, Stony Brook, NY (US); David Haarhoff, Hicksville, NY (US)

(73) Assignee: The Research Foundation of State University of New York, Albany, NY (US)

( * ) Notice: Subject to any disclaimer, the term of this patent is extended or adjusted under 35 U.S.C. 154(b) by 291 days.

(21) Appl. No.: 10/228,631

(22) Filed: Aug. 27, 2002

(65) Prior Publication Data

US 2004/0040115 A1 Mar. 4, 2004

(51) Int. Cl.[7] ..... A47L 5/16
(52) U.S. Cl. ..... 15/409; 15/408
(58) Field of Search ..... 15/405, 408, 409

(56) References Cited

U.S. PATENT DOCUMENTS 3,897,604 A * 8/1975 Weimer ..... 15/409
4,773,389 A * 9/1988 Hamasaki ..... 126/263.07
4,793,323 A * 12/1988 Guida et al. ..... 126/263.08
5,117,531 A * 6/1992 Hentzschel ..... 15/409
5,628,304 A * 5/1997 Freiman ..... 126/263.09
5,924,166 A * 7/1999 Jones et al. ..... 15/409
5,935,486 A * 8/1999 Bell et al. ..... 252/70
5,989,360 A * 11/1999 Hamilton ..... 15/409
6,094,778 A 8/2000 Boukas ..... 15/409
6,248,257 B1 * 6/2001 Bell et al. ..... 252/70
2004/0009107 A1 * 1/2004 Baker ..... 422/242

* cited by examiner

*Primary Examiner*—Theresa T. Snider
(74) *Attorney, Agent, or Firm*—Scully, Scott, Murphy & Presser

(57) ABSTRACT

A container including: at least one wall defining an interior cavity; a propellant disposed in the interior cavity; a release valve disposed in the at least one wall for selectively releasing the propellant from the interior cavity; and a heater for heating the propellant in the interior cavity. Preferably, the container is provided with a venturi device and operates as a suction device upon release of the propellant from the interior cavity into the venturi device.

15 Claims, 5 Drawing Sheets

PORTABLE, FULLY CONTAINED AND DISPOSABLE SUCTION DEVICE

BACKGROUND OF THE INVENTION

1. Field of the Invention

The present invention relates to a portable suction device and more particularly, to a fully contained, disposable portable suction device for attaching to a can of compressed gas for creating a suction.

2. Prior Art

Compressed gas cans for creating suction are well known in the art, particularly those having a venturi based nozzle head in which gas is discharged, such as that disclosed in U.S. Pat. No. 6,094,778 to Boukas, the contents of which is incorporated herein by its reference.

The suction from such devices can be used for cleaning wounds and other similar medical reasons, particularly for field applications by medical emergency personnel. Although such devices are useful, they rely on aerosol propellant in the can to generate the suction. The suction is based on the evaporation of liquids to generate gas flow from the can. As a result, the temperature of the liquid drops rapidly (the liquid may even freeze) thereby decreasing or stopping the gas outflow.

SUMMARY OF THE INVENTION

Therefore it is an object of the present invention to provide a suction device that overcomes the disadvantages associated with similar prior art suction devices.

Accordingly, a suction device is provided. The suction device comprises: a container having walls defining an interior cavity; a propellant disposed in the interior cavity; a venturi device having a propellant inlet in fluid communication with the interior cavity, a common outlet in fluid communication with the propellant inlet through a conduit, and a vacuum inlet in fluid communication with the conduit, wherein a vacuum is created at the vacuum inlet upon release of the propellant from the interior cavity to the propellant inlet and through the conduit to the common outlet; and a heater for heating the propellant in the interior cavity.

The suction device preferably further comprises a container disposed at the common outlet for collecting debris sucked into the conduit from the vacuum inlet.

Preferably, the walls of the container comprise a cylindrical sidewall, a top wall, and a bottom wall. In such a configuration, the suction device preferably further comprises a release valve disposed on one of the cylindrical sidewall, the top wall, and the bottom wall for selectively releasing the propellant from the interior cavity and/or a pressure relief valve disposed on one of the cylindrical sidewall, the top wall, and the bottom wall for automatically releasing pressure from the interior cavity when a pressure in the interior cavity is greater than a predetermined threshold pressure.

Preferably, the propellant is an aerosol propellant. The aerosol propellant is preferably at least partly maintained in a liquid state in the interior cavity. Preferably, the aerosol propellant is 1,1-Difluoroethane.

The heater is preferably at least partially disposed around the walls of the container. Alternatively, or in addition, the heater is at least partially disposed in a core of the interior cavity. Preferably, the heater generates heat by a chemical reaction. The chemical reaction preferably produces an exothermic reaction between at least a first and second component. Preferably, the first component is water and the second component is lime. The heater preferably further comprises an inert material that does not react with the first and second components for controlling the exothermic reaction. Preferably, the inert material is selected from a list consisting of an oil, a wax, and a surfactant.

Also provided is a container comprising: at least one wall defining an interior cavity; a propellant disposed in the interior cavity; a release valve disposed in the at least one wall for selectively releasing the propellant from the interior cavity; and a heater for heating the propellant in the interior cavity.

Preferably, the heater generates heat by a chemical reaction. The chemical reaction preferably produces an exothermic reaction between at least a first and second component. Preferably, the heater further comprises an inert material that does not react with the first and second components for controlling the exothermic reaction.

The container preferably further comprises a pressure relief valve disposed on the at least one wall for automatically releasing pressure from the interior cavity when a pressure in the interior cavity is greater than a predetermined threshold pressure.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Although this invention has been found to be particularly useful for suction devices and suction devices used for cleaning wounds and other similar medical reasons, those skilled in the art will appreciate that the applicability of the invention is not limited thereto. Those skilled in the art will appreciate that the present invention can be used for any container having at least a propellant disposed therein which is expelled from the container through a release valve. Furthermore, although it is also preferred that the suction device of the present invention be disposable, it can also be provided in a reusable configuration.

Figure 1A:
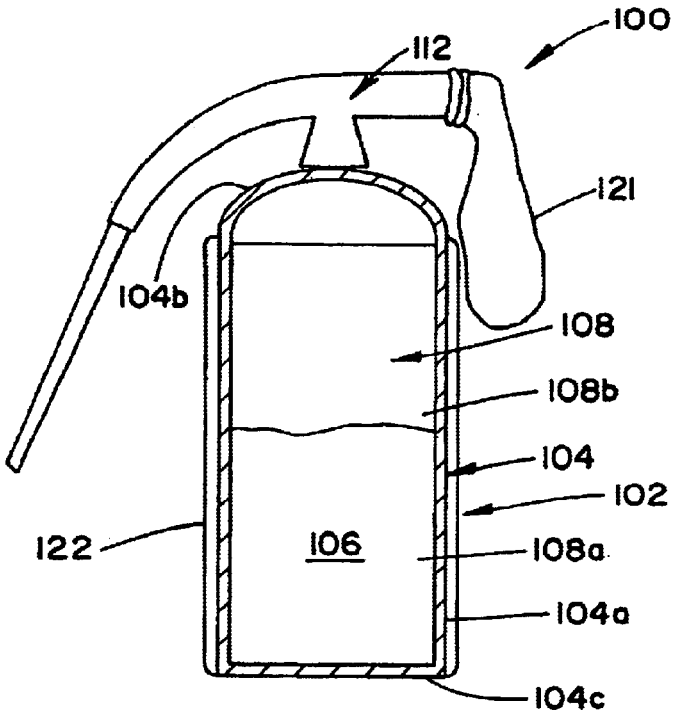
FIG. 1*a* illustrates a preferred implementation of a suction device according to the present invention and having a heater disposed around a cylindrical wall of a container of the suction device.

Referring now to FIG. 1*a*, there is illustrated a first implementation of the suction device of the present invention, the suction device being generally referred to by reference numeral 100. The suction device 100 consists of an aerosol container 102 having walls 104 defining an interior cavity 106. A propellant 108 is disposed in the interior cavity 106. The container walls 104 are preferably metallic and have a sufficient thickness to withstand the pressure of the propellant 108 contained in the interior cavity 106. The walls 104 preferably comprise a cylindrical sidewall 104*a*, a top wall 104*b*, and a bottom wall 104*c*.

Figure 4A:
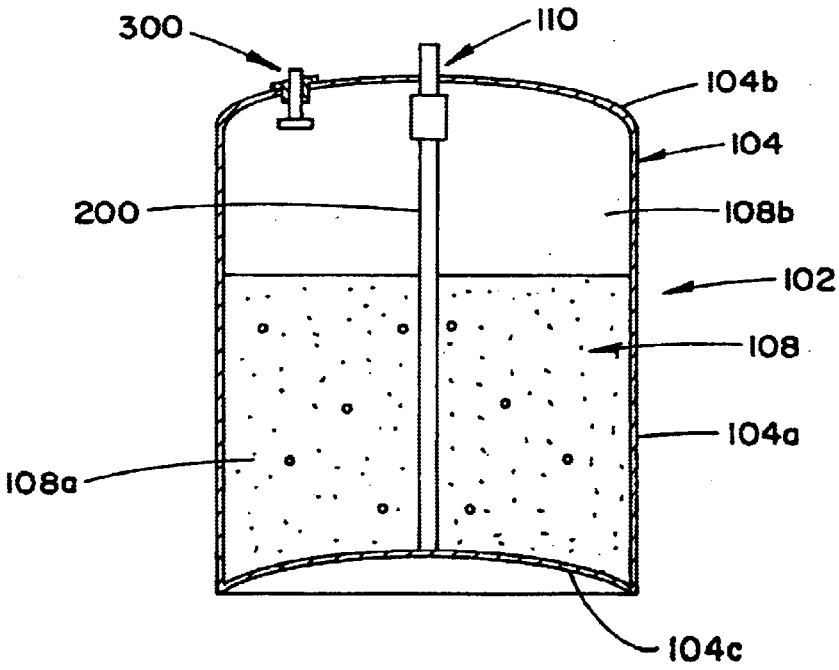
FIG. 4*a* illustrates a sectional view of the container, shown without the heater and venturi.
Figure 4B:
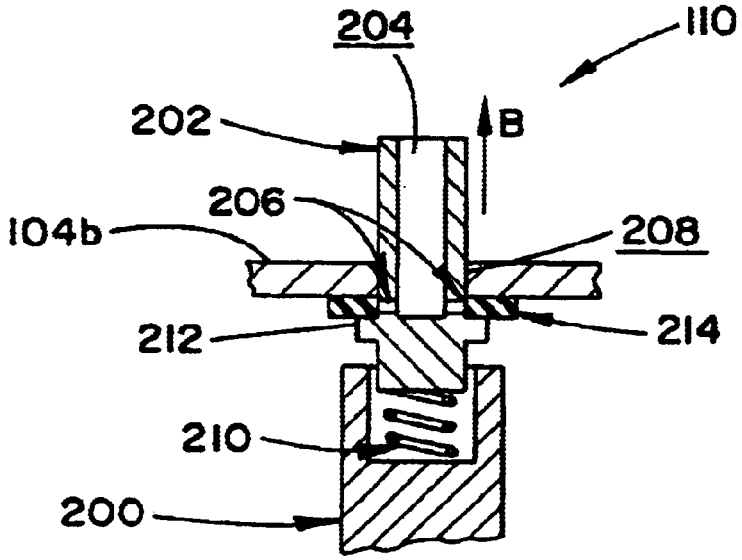
FIG. 4*b* illustrates a partial enlarged view of the container of FIG. 4*a* showing the propellant release valve.

The propellant 108 is preferably an aerosol propellant that is at least partially in a compressed liquid state 108*a* and a gaseous state 108*b*. The aerosol propellant is preferably 1,1-Difluoroethane. The preferred implementation of the suction device 100 of the present invention expels the gaseous portion 108*b* of the propellant 108 only. However, within the container 102, the propellant 108 is in two states. At the bottom of the container 102 the propellant 108 is in a compressed liquid state 108*b* while at the top of the container 102 the propellant 108 is in a gaseous state 108*a*. A release valve 110 disposed in the top wall 104*b* of the container 102 is designed only to deliver the gas propellant 108*b* from the top of the container 102. However, if the container 102 is inverted during use, the compressed liquid 108*a* can be expelled. FIGS. 4*a* and 4*b* show schematics of the container 102 and the release valve 110, respectively.

When propellant 108 is expelled from the aerosol container, the compressed liquid 108*a* boils and some propellant 108 evaporates from the compressed liquid state 108*a* into a gaseous state 108*b* until equilibrium is achieved. Energy or heat of evaporation is required for a phase change to occur. If the suction device 100 is used for an extended period of time, the amount of heat required to continue to cause evaporation is greater than the heat provided by the surroundings. The temperature within the container 102 rapidly decreases and the evaporation process slows down and eventually all but stops. To avoid this, a heater 122 (discussed below) is provided to produce the necessary heat of evaporation.

A preferred aerosol propellant for the suction device 100 of the present invention is 1,1-Difluoroethane (reference #75-37-6) because it is a non-ozone depleting propellant with a very low toxicity rating and a boiling temperature of −23° C. (−13° F.), all of which make it ideal for suction device of the present invention. Its Heat of Vaporization, $q_v$ at room temperature is $21.73^{kJ}$/mol. Further properties of 1,1-Difluoroethane can be found in Table 1 below.

Figure 2:
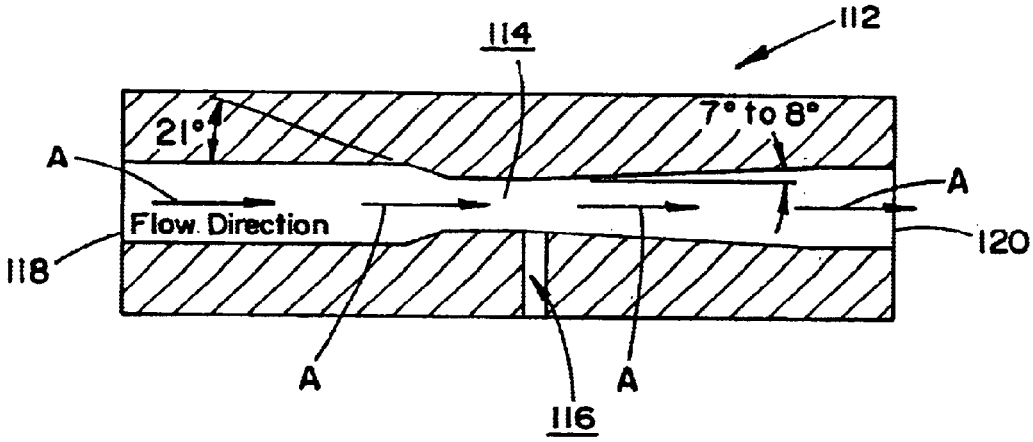
FIG. 2 illustrates a schematic of a venturi for use with the suction device of FIGS. 1*a* and 1*b*.
Figure 3A:
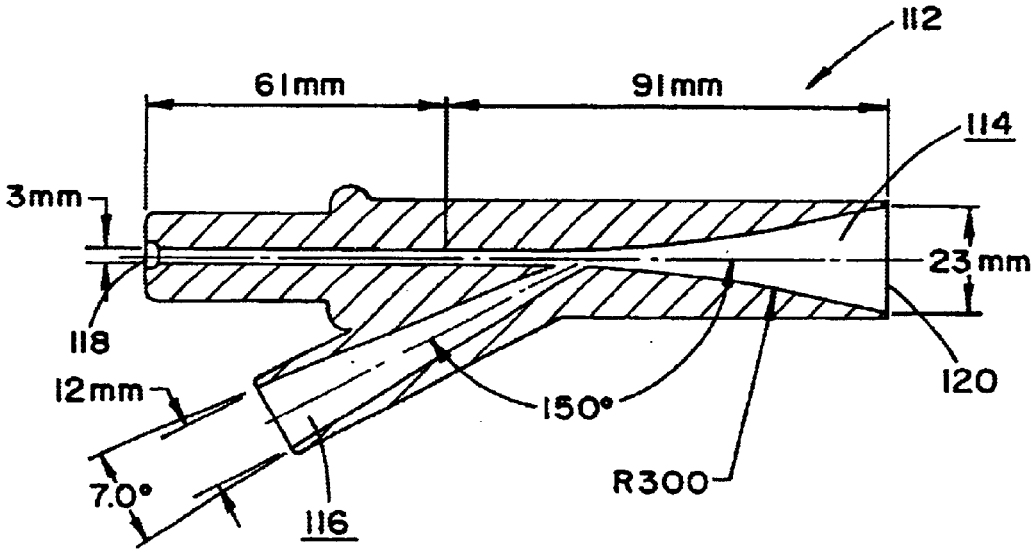
FIGS. 3*a*–3*d* illustrate variations in the venturi configuration.
Figure 3B:
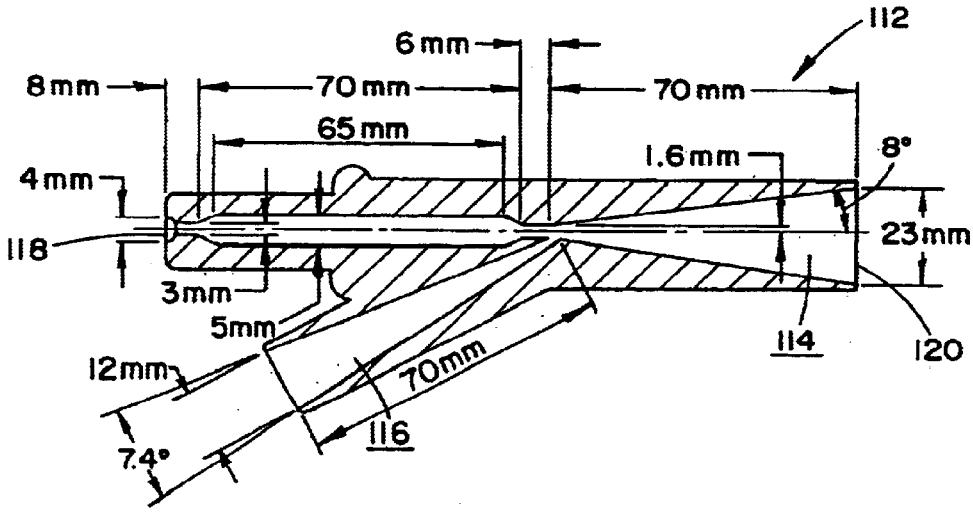
Figure 3C:
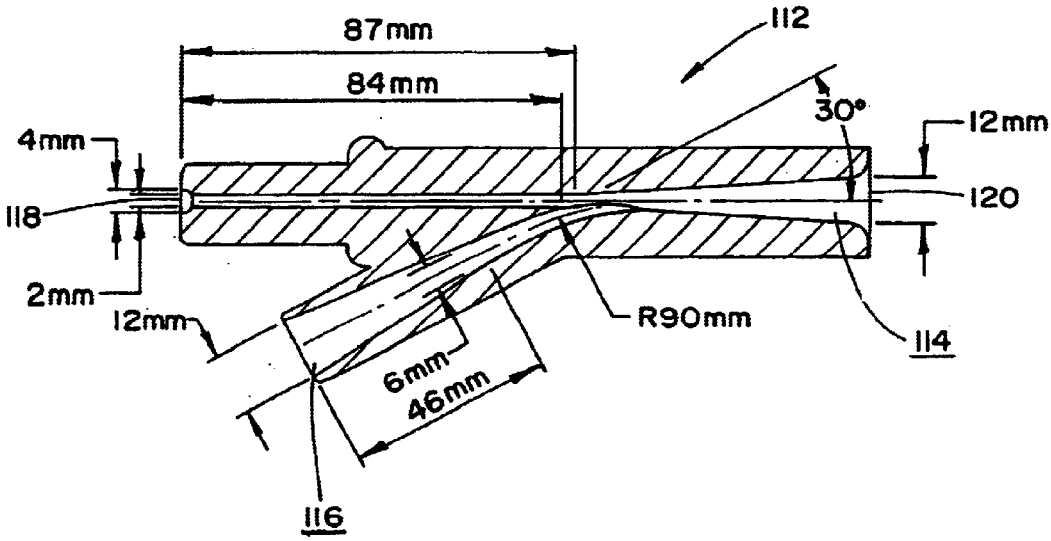
Figure 3D:
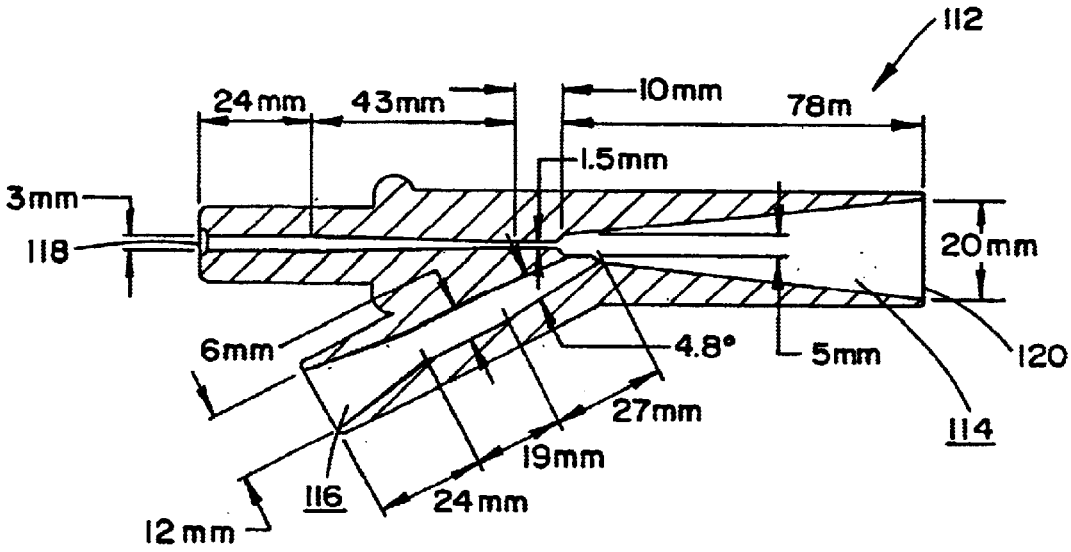

As discussed briefly above, the container 102 further has a release valve 110 (discussed in detail below with regard to FIGS. 4*a* and 4*b*) in communication with the propellant 108 in the interior cavity 106. A venturi device 112 is attached to the release valve 110 of the container 102. A schematic of a typical venturi device 112 is shown in FIG. 2. FIG. 2 shows a schematic of a basic design of generating a vacuum using a venturi. In the simplest form, when a moving fluid moves through a conduit 114 and passes an inlet 116, as shown by arrows A in FIG. 2, a low pressure develops at the inlet 116. If the low pressure is sufficiently low relative to the external pressure, the inlet 116 can be used as a vacuum. The conduit 114 has a propellant inlet 118 that is in fluid communication with the interior cavity 106 through the release valve 110. The conduit 114 further has a common outlet 120 in fluid communication with the propellant inlet 118 through the conduit 114. The vacuum inlet 116 is in fluid communication with the conduit 114, such that a vacuum is created at the vacuum inlet 116 upon release of the propellant 108 from the interior cavity 106 to the propellant inlet 118 and through the conduit 114 to the common outlet 120.

TABLE 1

Standard Properties of 1,1-Difluoroethane

| | |
|---|---|
| Names: | 1,1-Difluoroethane<br>Hydrocarbon 152a<br>Dymel-152a |
| Chemical Reference Number: | 75-37-6 |
| Chemical Formula: | $C_2H_4F_2$ or $CH_3CHF_2$ |
| Molecular Mass: | 66.1 g/mol |
| Boiling Point: | −23° C.<br>−13° F. |
| Vapor Pressure: | |
| at 20° C. | 416 kPa |
| at 50° C. | 1086 kPa |
| at 70° F. | 63 psig |
| at 130° F. | 177 psig |
| Specific Heat of Gas (at 25° C.) | 69.1 J/(mol.K) |
| Specific Heat of Liquid (at 25° C.) | 100.76 J/(mol.K) |
| Heat of Vaporization (at 25° C.) | 21.73 kJ/mol |
| Liquid Density (at 25° C.) | 0.898 g/ml |
| Viscosity of Gas (at 25° C.) | 118.1 micropoise |
| Thermal Conductivity of Gas (at 25° C.) | 0.0115 W/(m.K) |
| Thermal Conductivity of Liquid (at 25° C.) | 0.1041 W/(m.K) |

By varying the geometry of the conduit 114 and inlet 116, the venturi device 112 can be designed to produce the greatest pressure drop at the inlet 116. ASME prescribes standards to be used for the design of flow meters and other venturi devices. FIG. 2 shows the basic ASME standards for venturi devices. By using these standards as a benchmark, four improved venturi devices are provided. Their relative geometries can be seen in FIGS. 3*a*, 3*b*, 3*c* and 3*d*. The dimensions given are for a suitably sized container 102. However, they can be scaled up or down depending upon the application. A container 121, such as a bag is preferably provided at the common outlet 120 for collecting debris sucked into the conduit 114 from the vacuum inlet 116. The container 121 is preferably constructed from a mesh material such that the propellant 108 can escape therefrom, but debris is trapped therein. The container 121 is further preferably removable so that the debris captured therein can be discarded.

Figure 1B:
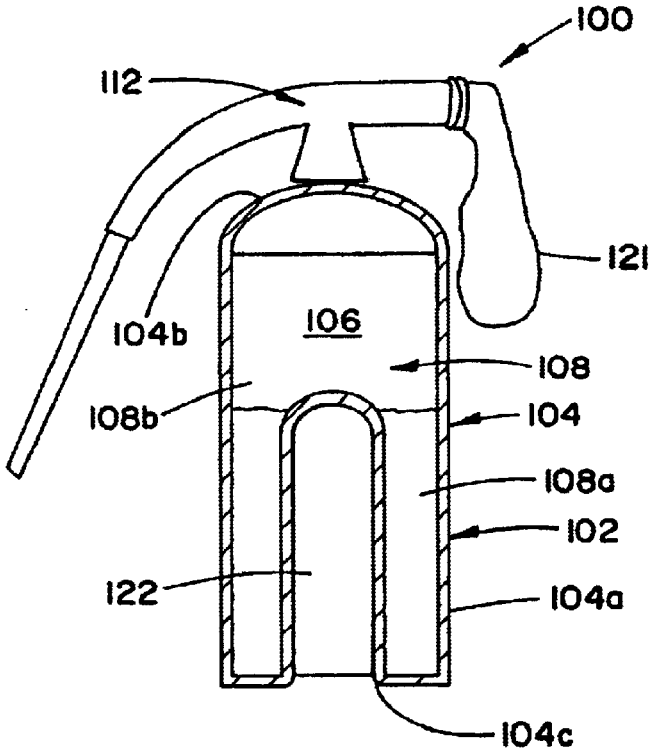
FIG. 1*b* illustrates a variation of the suction device of FIG. 1*a* having a heater disposed in a core of the container of the suction device.

The suction device 100 further has a heater 122 for heating the propellant 108 in the interior cavity 106. As shown in FIG. 1, the heater 122 is preferably attached to the exterior of the container walls 104 as a jacket. Alternatively, as illustrated in FIG. 1*b*, the heater 122 can be configured in a core of the container 102. In such a configuration, the bottom wall 104*c* is preferably configured with a concavity to accept the heater 122. The heater 122 provides heat to the container 102 to replace the heat used during the propellant's phase change from a compressed liquid 108*a* to a gas 108*b*. Furthermore, the heat from the heater 122 can be useful where very little propellant 108 is left in the interior cavity 106 to increase the pressure of the propellant 108 so that more of the propellant 108 can be expelled from the container then would be possible if the heater 122 were not provided.

The heater 122 is preferably similar to those used for self-heating packages, which are well known in the food arts, such as that disclosed in (1) U.S. Pat. No. 5,628,304 to Freiman et al., in which anhydrous calcium chloride and water are mixed with a cutting device that is used to open the water compartment and allow water to contact the anhydrous calcium chloride and release heat; (2) U.S. Pat. No. 4,773,389 to Hamasaki et al., in which the heater is activated by sliding a support member in contact with the body to cause a liquid to be discharged into a second chamber to initiate an exothermic reaction; and (3) U.S. Pat. No. 4,793,323 to Guida et al., in which an upper and a lower compartment are separated by a membrane, the upper compartment containing a solid reactant and the lower containing an activating liquid, where the exothermic reaction is initiated by actuating a membrane-breaking member in the liquid compartment. The contents of U.S. Pat. Nos. 5,628,304, 4,773,389, and 4,793,323 are incorporated herein by their reference.

If the entire contents of a standard 315 ml aerosol container, containing about 285 g of 100% 1,1-Difluoroethane propellant is to be used, the total heat required for complete evaporation can be calculated as follows.

The molar mass, $M_{1,1\text{-}Difluoroethane}$ of 1,1-Difluoroethane is $66.1^{g}$/mol Total number of moles, $n_{1,1\text{-}Difluoroethane}$ in 285 g of 1,1-Difluoroethane $$n_{1,1-Difluoroethane} = \frac{m_{1,1-Difluoroethane}}{M_{1,1-Difluoroethane}} = \frac{285\text{ g}}{66.1\ \frac{\text{g}}{\text{mol}}} = 4.312\text{ mol} \quad (1)$$

Total Heat, $Q_{1,1\text{-}Difluoroethane}$ required to evaporate 4.311 mol at room temperature is $$Q_{1,1-Difluoroethane} = n_{1,1-Difluoroethane} \times q_{1,1-Difluoroethane} = 21.73\ \frac{\text{kJ}}{\text{mol}} \times 4.311\text{ mol} = 93.68\text{ kJ} \quad (2)$$

In order to use the entire aerosol container, 94 kJ of energy are required to be put into the system. If we assume that the initial heat available from the environment is negligible, then the heater 122 must produce all 94 kJ of energy.

In order to keep the suction device 100 portable, disposable and simple, a variety of heating devices ranging from resistance heating to chemical heating can be used. The preferred heater 122 is a chemical heating device using an exothermic reaction between Lime (CaO) and water ($H_2O$). Lime reacts with water according to the following equation, $$CaO(s)+H_2O(l) \rightarrow Ca(OH)_2\ (aq)+\text{Heat} \quad (3)$$

Using standard Enthalpy tables, the heat produced during this reaction can be calculated. The Heat of Formation for water ($\Delta H_{f\text{-}H2O}$) and of lime ($\Delta H_{f\text{-}CaO}$) are $-286^{kJ}$/mol and $-635^{kJ}$/mol respectively. The total heat produced, $Q_{\text{-}reaction}$ during the reaction is equal to the negative of the Heat of reaction ($\Delta H_{f\text{-}Reaction}$).

$$\begin{aligned} Q_{-Reaction} &= -\Delta H_{f-Reaction} \\ &= \sum \Delta H_{f-Products} - \sum \Delta H_{f-Reactance} \\ &= -(\Delta H_{f-Ca(OH)_2} - \Delta H_{f-CaO} - \Delta H_{f-H_2O}) \\ &= -\left(\left(-987\ \frac{\text{kJ}}{\text{mol}}\right) - \left(-635\ \frac{\text{kJ}}{\text{mol}}\right) - \left(-286\ \frac{\text{kJ}}{\text{mol}}\right)\right) \\ &= 66\ \frac{\text{kJ}}{\text{mol}} \end{aligned} \quad (4)$$

Since the heater 122 must produce 94 kJ of heat, 1.42 mol of $Ca(OH)_2$ is needed according to the following equation.

$$n_{Ca(OH)_2} = \frac{Q_{1,1-Difluoroethane}}{Q_{Reaction}} = \frac{94\text{ kJ}}{66\ \frac{\text{kJ}}{\text{mol}}} = 1.42\text{ mol} \quad (5)$$

From Equation 3 we see that 1 mol of water will react with 1 mol of lime to produce 1 mol of $Ca(OH)_2$ it follows that the heater 122 will need 1.42 mol of both water and lime. Using the Molar Mass of water ($18.00^{g}$/mol) and the Molar Mass of Lime ($56.08^{g}$/mol) the total amount of each substance needed to produce 1.42 mol of $Ca(OH)_2$ can be calculated to be, $$m_{H_2O} = M_{H_2O} \times n_{H_2O} = 18.00\ \frac{\text{g}}{\text{mol}} \times 1.42\text{ mol} = 25.56\text{ g} \quad (6)$$

$$m_{CaO} = M_{CaO} \times n_{CaO} = 56.08\ \frac{\text{g}}{\text{mol}} \times 1.42\text{ mol} = 79.63\text{ g} \quad (7)$$

The total amount of $Ca(OH)_2$ produced is just the sum of these two.

$$m_{Ca(OH)_2} = m_{H_2O} + m_{CaO} = 25.56\text{ g} + 79.63\text{ g} = 105.19\text{ g} \quad (8)$$

From the above equations and calculations, the amount of lime and water required to produce the desired amount of heat (94 kJ) is known.

Although water and lime are preferred, a variety of heat-producing compositions can be employed in the practice of the present invention. Another preferred heat-producing composition is calcium chloride. Preferred heat-producing compositions are those that are activated by the addition of a liquid, preferably water or an aqueous solution, to the heat-producing compositions. Heat-producing compositions can also include other inexpensive materials such as sodium sulfate and magnesium chloride and mixtures thereof. Particularly useful heat-producing compositions are described in PCT/US97/12846; U.S. Pat. No. 5,935,486; and U.S. patent application Ser. No. 09/351,821, filed Jul. 12, 1999, all of which are incorporated by reference herein in their entirety to the extent that they are not inconsistent with the disclosure herein. Heat-producing compositions can comprise an active heat-producing component in combination with an inert material. The inert material does not react with the activating solution to generate a substantial amount of heat and can serve to moderate or control heat release on activation. The inert material may serve to inhibit access of the activating solution to the active heat-producing components. Inert materials can include mixtures of surfactants, wax, and/or oil.

The heat-producing compositions can also contain a mixture of active components, such as CaO or combinations of CaO with $P_2O_5$ or $MgCl_2$ in combination with the inert material that can be a mixture of surfactant, oil, and/or wax. Heat-producing compositions can be prepared for example, as pads, pellets or powders. The rate of heat generation in the heaters 122 of the present invention can be controlled by selection of the type of active ingredients, the amount of inert material included and the physical form of the composition.

Referring now to FIGS. 4*a* and 4*b*, there is shown a schematic illustration of the suction device 100 without the venturi 112 and heater 122. The release valve 110 is disposed on one of the cylindrical sidewall 104*a*, the top wall 104*b*, or the bottom wall 104*c* for selectively releasing the propellant 108 from the interior cavity 106. The propellant 108 is shown in FIG. 4*a* having a gaseous portion 108*b* and a liquid portion 108*a*. The release valve 110 is preferably located on the top wall 104*b* proximate to the gaseous portion 108*b* of the propellant 108 and is supported by a valve support rod 200. The valve support rod 200 supports the release valve 110 in the top wall 104*b* of the container 102. The release valve 110 has a plunger 202 that has a vertical opening 204 and at least one horizontal opening 206. The plunger 202 is slidingly disposed in a hole 208 in the top wall 104*b* of the container 102 and is biased upward in the direction of arrow B by a spring 210. A first portion of the spring 210 is seated in the valve support rod 200 and a second portion of the spring 210 contacts the plunger 202. The plunger 202 further has a flange 212. A gasket 214 is disposed between the top wall 104*b* and the flange 212 to seal the horizontal openings 206 when the plunger 202 is biased upward in the direction of arrow B. When the plunger 202 is depressed downward in the direction opposite to that of arrow B, the propellant 108 in the interior cavity 106 is permitted to escape from the horizontal openings 206 and into the vertical opening 204. The propellant inlet 118 of the venturi device 112 is positioned on the plunger 202 so as to be in fluid communication with the vertical opening 204. The plunger 202 is generally depressed by depressing the venturi connected thereto. However, a separate mechanism can be provided to selectively depress the plunger 202.

Figure 4C:
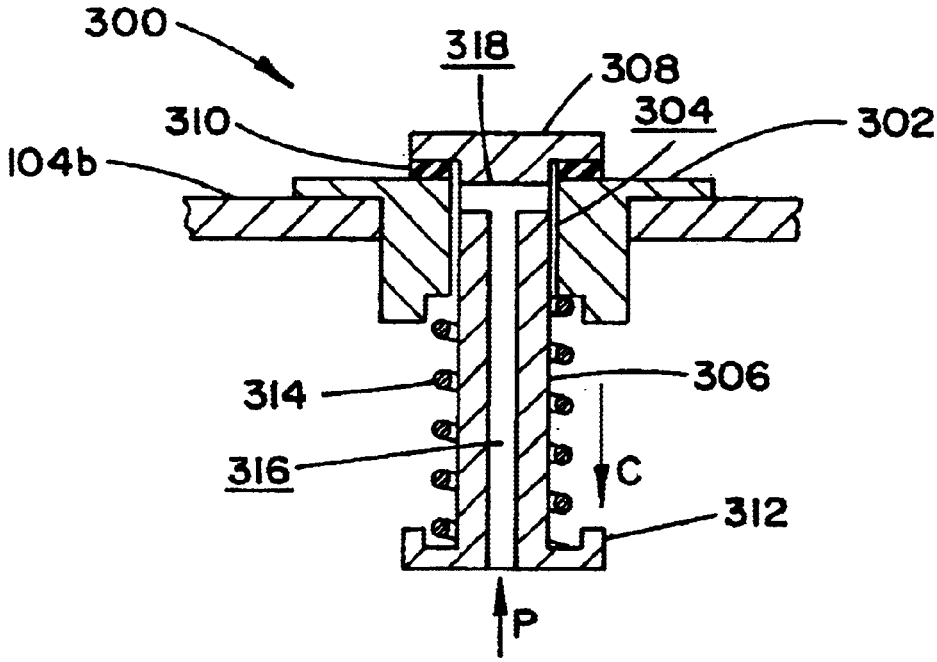
FIG. 4*c* illustrates a partial enlarged view of the container of FIG. 4*a* showing the pressure relief valve.

Referring now to FIGS. 4*a* and 4*c*, the suction device preferably further comprises a pressure relief valve 300 disposed on one of the cylindrical sidewall 104*a*, the top wall 104*b*, or the bottom wall 104*c* for automatically releasing pressure from the interior cavity 106 when a pressure in the interior cavity 106 is greater than a predetermined threshold pressure. Because of the addition of the heater 122, the pressure of the propellant 108 may increase and threaten to burst the container 102 or compromise the integrity of the release valve 110.

The pressure relief valve 300 is preferably disposed in the top wall 104*b* of the container 102 proximate the gas portion 108*b* of the propellant 108. The pressure relief valve 300 has a bushing 302 having a bore 304. The bushing 302 is preferably sealed to the top wall 104*b* by brazing. The pressure relief valve 300 further has a plunger 306 that is slidingly disposed in the bore 304. The plunger has a sealing flange 308 on an exterior of the container 102. A gasket 310 is disposed between the sealing flange 308 and a surface of the bushing 302. The plunger 306 further has a lower flange 312 on an opposite end from the sealing flange 308. A spring 314 is disposed between a surface of the bushing 302 and the lower flange 312 to bias the plunger in the direction of arrow C to seal the sealing flange 308 against the gasket 310. The plunger 306 is also provided with a vertical hole 316 and at least one horizontal opening 318. When the pressure P inside the interior cavity 106 is below a predetermined threshold pressure, the sealing flange 308 is sealed against the gasket 310 by the biasing force of the spring 314. When the pressure P inside the interior cavity 106 exceeds the predetermined threshold pressure, the force on the lower flange 312 overcomes the biasing force of the spring 314 and the plunger moves in a direction opposite to that of arrow C to unseat the sealing flange 308 from the gasket 310 and expose the horizontal holes 318 to the atmosphere and vent the interior cavity 106 until the pressure P drops below the predetermined threshold pressure.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A suction device comprising:

a container having walls defining an interior cavity;

a propellant disposed in the interior cavity;

a venturi device having a propellant inlet in fluid communication with the interior cavity, a common outlet in fluid communication with the propellant inlet through a conduit, and a vacuum inlet in fluid communication with the conduit, wherein a vacuum is created at the vacuum inlet upon release of the propellant from the interior cavity to the propellant inlet and through the conduit to the common outlet; and a heater for heating the propellant in the interior cavity.

2. The suction device of claim 1, further comprising a container disposed at the common outlet for collecting debris sucked into the conduit from the vacuum inlet.

3. The suction device of claim 1, wherein the walls comprise a cylindrical sidewall, a top wall, and a bottom wall.

4. The suction device of claim 3, further comprising a release valve disposed on one of the cylindrical sidewall, the top wall, and the bottom wall for selectively releasing the propellant from the interior cavity.

5. The suction device of claim 3, further comprising a pressure relief valve disposed on one of the cylindrical sidewall, the top wall, and the bottom wall for automatically releasing pressure from the interior cavity when a pressure in the interior cavity is greater than a predetermined threshold pressure.

6. The suction device of claim 1, wherein the propellant is an aerosol propellant.

7. The suction device of claim 6, wherein the aerosol propellant is at least partly maintained in a liquid state in the interior cavity.

8. The suction device of claim 7, wherein the aerosol propellant is 1,1-Difluoroethane.

9. The suction device of claim 1, wherein the heater is at least partially disposed around the walls of the container.

10. The suction device of claim 1, wherein the heater is at least partially disposed in a core of the interior cavity.

11. The suction device of claim 1, wherein the heater generates heat by a chemical reaction.

12. The suction device of claim 11, wherein the chemical reaction produces an exothermic reaction between at least a first and second component.

13. The suction device of claim 12, wherein the first component is water and the second component is lime.

14. The suction device of claim 12, wherein the heater further comprises an inert material that does not react with the first and second components for controlling the exothermic reaction.

15. The suction device of claim 14, wherein the inert material is selected from a list consisting of an oil, a wax, and a surfactant.

* * * * *